US007806110B1

(12) United States Patent
Broman et al.

(10) Patent No.: US 7,806,110 B1
(45) Date of Patent: Oct. 5, 2010

(54) TURBOCHARGER CONFIGURATION FOR AN OUTBOARD MOTOR

(75) Inventors: Jeffrey J. Broman, Slinger, WI (US); Eric S. Mueller, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 486 days.

(21) Appl. No.: 11/900,421

(22) Filed: Sep. 11, 2007

(51) Int. Cl.

| | |
|---|---|
| ***F02B 33/00*** | (2006.01) |
| ***F02B 37/00*** | (2006.01) |
| ***B63H 21/26*** | (2006.01) |
| ***B63H 21/10*** | (2006.01) |
| ***B63H 21/38*** | (2006.01) |

(52) U.S. Cl. ..... 123/559.1; 123/196 W; 440/88 R

(58) Field of Classification Search ..... 123/559.1, 123/196 W; 440/88 R; *F02B 21/26, 37/00*
See application file for complete search history.

(56) References Cited

U.S. PATENT DOCUMENTS

| | | | | |
|---|---|---|---|---|
| 2,289,124 | A * | 7/1942 | Karey | 123/196 W |
| 2,351,050 | A * | 6/1944 | Karey | 440/88 R |
| 2,431,806 | A * | 12/1947 | Karey | 123/196 W |
| 3,150,650 | A * | 9/1964 | Dreesen et al. | 123/559.1 |
| 3,998,055 | A | 12/1976 | Bradford et al. | 60/599 |
| 4,677,826 | A * | 7/1987 | Iwai et al. | 60/602 |
| 4,760,704 | A | 8/1988 | Torigai | 60/612 |
| 4,827,722 | A | 5/1989 | Torigai | 60/599 |
| 5,261,356 | A | 11/1993 | Takahashi et al. | 123/563 |
| 5,293,846 | A | 3/1994 | Takahashi | 123/559.1 |
| 6,032,466 | A | 3/2000 | Woollenweber et al. | |
| 6,405,692 | B1 | 6/2002 | Christiansen | 123/559 |
| 6,408,832 | B1 | 6/2002 | Christiansen | 123/559.1 |
| 6,409,558 | B1 | 6/2002 | Gokan et al. | 440/89 |
| 7,189,005 | B2 | 3/2007 | Ward | 384/ 286 |
| 2006/0083609 | A1 | 4/2006 | Augspurger | 415/206 |
| 2007/0107424 | A1 | 5/2007 | Wizgall et al. | 60/597 |

FOREIGN PATENT DOCUMENTS

| | | | | |
|---|---|---|---|---|
| JP | 01306390 | A * | 12/1989 | 123/559.1 |

* cited by examiner

*Primary Examiner*—Thai Ba Trieu
(74) *Attorney, Agent, or Firm*—William D. Lanyi

(57) ABSTRACT

A marine propulsion device is provided with a turbocharger that is located above all, or at least a majority of, the cylinders of an engine. The exhaust gases are directed to one side of the engine and the compressed air is directed to an opposite side of the engine. The turbocharger is located at a rear portion of the engine behind the crankshaft.

2 Claims, 7 Drawing Sheets

TURBOCHARGER CONFIGURATION FOR AN OUTBOARD MOTOR

BACKGROUND OF THE INVENTION

1. Field of the Invention

The present invention relates generally to an outboard motor with a turbocharger and, more particularly, to a marine propulsion system in which a turbocharger is disposed above most of, if not all, of the cylinders of an engine in which the cylinders are vertically distributed and, in certain embodiments of the present invention, the turbocharger is located at a rearward portion of the engine above all of the cylinders.

2. Description of the Related Art

Turbochargers are well known by those skilled in the art for use in conjunction with internal combustion engines. Exhaust gases are used to drive a turbine which is connected in torque transmitting relation with a compressor. The compressor provides pressurized charge air that is used, within the cylinders, in the combustion process. Turbochargers are also known to those skilled in the art for use in conjunction with marine propulsion systems, including outboard motors. The patents described immediately below illustrate various types of turbochargers used in both marine applications and non-marine applications. Some of these patents are intended for use in conjunction with outboard motors.

U.S. Pat. No. 3,998,055, which issued to Bradford et al. on Dec. 21, 1976, describes a turbocharger for marine engines. It includes a dual chamber block interposed between a carburetor and a turbocharger. The block includes a first chamber for receipt of a fuel air mixture and a second chamber separated by a heat transfer wall from the first chamber. The second chamber receives hot water from the cooling system of the engine and effectively directs heat through the heat transfer wall to prevent condensation of fuel from the fuel air mixture in the first chamber. Consequently, it is possible to use a rich air fuel mixture and maintain the mixture in a vaporized state to prevent premature detonation and deterioration of the engine.

U.S. Pat. No. 4,760,704, which issued to Torigai on Aug. 2, 1988, describes a multi-cylinder engine with a turbocharger. It describes two-cycle, turbocharged internal combustion engines which have improved arrangements for locating the inlet of the turbine stage so as to minimize the necessity for backflow in the exhaust conduit. This system is described in conjunction with outboard motors and, in certain embodiments, with twin turbochargers. The turbochargers are disposed in such a relationship so as to permit a compact relationship and to avoid close proximity between the exhaust conduit and the compressor stages.

U.S. Pat. No. 4,827,722, which issued to Torigai on May 9, 1989, describes an engine of a turbocharger for an outboard motor. The engine is provided with a plurality of carburetors that draw air through a common plenum chamber. The turbochargers deliver pressurized air to the plenum chamber and an inner core is formed in the plenum chamber by having a heat exchanger extending across the plenum chamber. The inner core is cooled by circulating engine coolant through it.

U.S. Pat. No. 5,261,356, which issued to Takahashi et al. on Nov. 16, 1993, describes an outboard motor. A supercharged outboard motor includes a water cooling jacket that encircles the supercharger and also the duct which interconnects the supercharger with the engine for cooling of the supercharger and compressed air charge without necessitating a separate intercooler.

U.S. Pat. No. 5,293,846, which issued to Takahashi on Mar. 15, 1994, describes a two-cycle engine for an outboard motor.

The outboard motor includes a supercharged internal combustion engine. The supercharger is positioned on a side of the crankcase opposite from the cylinders of the engine and is driven by the crankshaft through any of a plurality of different forms of drive arrangements that permit axial adjustments to maintain alignment.

U.S. Pat. No. 6,032,466, which issued to Woollenweber et al. on Mar. 7, 2000, describes a motor assisted turbocharger for an internal combustion engine. An efficient and reliable motor assisted turbocharger includes an assisting electric motor, a combination flow turbine wheel which may be inserted and removed from the turbocharger assembly through the exhaust opening of the turbine casing, and a divided volute turbine casing designed in a unique way so that the tips of the turbine blades can be extended to be closely adjacent to the turbine casing divider wall without complicating the mechanical design of the turbine, thereby providing an economical assembly with high turbine efficiency compared with conventional, radial turbines used in turbochargers.

U.S. Pat. No. 6,405,692, which issued to Christiansen on Jun. 18, 2002, discloses an outboard motor with a screw compressor supercharger. The screw compressor provides a pressurized charge for the combustion chambers of the engine. It has first and second screw rotors arranged to rotate about vertical axes which are parallel to the axis of a crankshaft of the engine. A bypass valve regulates the flow of air through a bypass conduit extending from an outlet passage of the screw compressor to the inlet passage of the screw compressor.

U.S. Pat. No. 6,408,832, which issued to Christiansen on Jun. 25, 2002, discloses an outboard motor with a charge air cooler. The charge air cooler is used in a preferred embodiment and the bypass conduit extends between the cold side plenum of the charge air cooler and the inlet of the compressor. The charge air cooler improves the operating efficiency of the engine and avoids overheating the air as it passes through the supercharger after flowing through the bypass conduit. The bypass valve is controlled by an engine control module in order to improve power output from the engine at low engine speeds while avoiding any violation of existing limits on the power of the engine at higher engine speeds.

U.S. Pat. No. 6,409,558, which issued to Gokan et al. on Jun. 25, 2002, describes a turbocharged engine structure for small sized boats. An engine is provided with an exhaust manifold and is disposed such that a crankshaft thereof extends in forward and rearward directions of a boat body, and an exhaust gas turbocharger which is driven to rotate by exhaust gas from the exhaust manifold is provided rearwardly of and adjacent to the exhaust manifold and rearwardly of and to adjacent to the engine. The exhaust gas turbocharger is disposed such that a shaft which connects a turbine and a compressor is directed in leftward and rightward directions of the boat body, and the turbine is disposed adjacent to the exhaust manifold and the compressor is disposed adjacent to an intake port of the engine. An intercooler is provided sidewardly of the compressor and disposed below an intake chamber.

U.S. patent application Ser. No. 10/965,524, which was filed by Augspurger on Oct. 14, 2004, describes a fluid cooled marine turbine housing. A method for reworking a corroded turbine housing for a turbocharger of a marine engine so that the corroded housing may be restored and reused is described. A turbine housing includes a central aperture for containing a turbine blade assembly and directing exhaust gases past the turbine blades in a turbocharger. The central aperture of a used turbine housing often is corroded such that the central aperture is enlarged and allows significant leakage. The corrosion may be removed and the aperture enlarged to receive an insert.

U.S. Pat. No. 7,189,005, which issued to Ward on Mar. 13, 2007, describes a bearing system for a turbocharger. The system is simple in design and easy to manufacture and has desired rotational dynamics of a three piece bearing design yet also has the superior vibration damping characteristics of a one piece bearing design. The inboard end of each journal bearing includes an axial recess for receiving an outboard end of a cylindrical bearing spacer, thereby axially locating the journal bearings as well as axially and radially locating the bearing spacer.

U.S. patent application Ser. No. 11/600,825, which was filed by Wizgall et al. on Nov. 17, 2006, describes a V-engine having at least one turbocharger. The engine also has at least two cylinders, and is constructed as a diesel engine and as an outboard motor for aquatic vehicles and wherein an exhaust to gas system leading from the minimum of two cylinders to the minimum of one turbocharger is arranged in the interior of a V formed by the cylinders. A vertically arranged crankshaft, cylinder heads which are designed to fold over, and coolant circuits supplied with seawater may also be provided in the V-engine.

The patents described above are hereby expressly incorporated by reference in the description of the present invention.

When turbochargers are used in marine applications, particularly in outboard motor applications, several additional problems must be addressed that do not normally occur in automotive or other non-marine applications. One problem relates to the limited space available for components, such as turbochargers, under the cowl of the outboard motor. Another problem relates to the potential inversion of water, from a body of water on which the marine vessel is operated, during certain conditions when internal pressures within the exhaust system and cylinders can induce the upward flow of water in a reverse direction through the exhaust system and toward the cylinders. In addition to the potential damage that this type of water inversion can cause to the engine, it can also draw water into and through the turbocharger and result in serious damage to the operability of the turbocharger. Therefore, it would be significantly beneficial if an outboard motor could be provided with a turbocharger in such a way that the turbocharger could be appropriately packaged under the cowl within the accommodating space and also reduce or inhibit the likelihood of damage in the event that water is drawn upwardly in a reverse direction through the exhaust system.

SUMMARY OF THE INVENTION

A marine propulsion system made in accordance with a preferred embodiment of the present invention comprises an engine and a turbocharger. The engine comprises a plurality of cylinders and a plurality of pistons operatively attached to a crankshaft, each of the plurality of pistons is disposed within an associated one of the plurality of cylinders and the crankshaft is supported for rotation about a generally vertical axis. The turbocharger comprises a turbine portion and a compressor portion. The turbocharger is disposed above a generally horizontal plane that extends through a vertical center of said plurality of cylinders. The turbine portion comprises a turbine rotor supported for rotation about a turbine axis and the compressor portion comprises a compressor rotor supported for rotation about a compressor axis.

The plurality of cylinders is distributed vertically in a configuration which is generally perpendicular to the generally horizontal plane. The turbine axis and the compressor axis, in a preferred embodiment of the present invention, are coaxial and disposed collinearly with a turbocharger axis. The turbocharger axis is generally parallel with the generally horizontal plane and is disposed above every one of the plurality of cylinders in a particularly preferred embodiment of the present invention. In alternative embodiments, the turbocharger is disposed above a majority of the plurality of cylinders.

In a preferred embodiment of the present invention, it further comprises a turbine inlet configured to conduct exhaust gas from the engine into the turbocharger, a turbine outlet configured to conduct exhaust gas from the turbocharger to an exhaust passage of the marine propulsion system, a compressor inlet configured to direct air into the turbocharger, and a compressor outlet configured to direct air from the turbocharger to the plurality of cylinders of the engine. In a preferred embodiment of the present invention, the turbine inlet and the turbine outlet are connected in fluid communication with the engine at locations on a first side of a generally vertical plane extending through the crankshaft of the engine with the plurality of cylinders being generally equally distributed on both sides of the generally vertical plane. The compressor outlet is connected in fluid communication with the engine at a location on a second side of the first generally vertical plane in a preferred embodiment of the present invention. The turbocharger is disposed behind the crankshaft and behind a second generally vertical plane which extends through the vertical center of the plurality of cylinders and is generally perpendicular to the generally horizontal plane.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
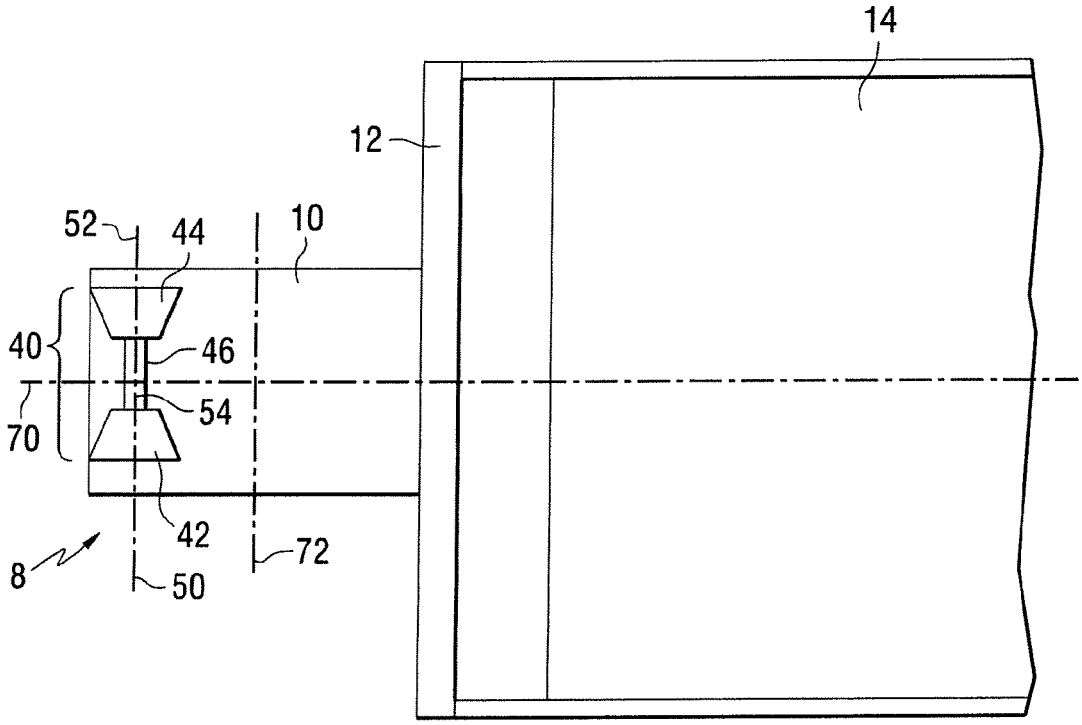
FIGS. 1 and 2 are highly simplified illustrations showing the relative positions of the various components of a preferred embodiment of the present invention.

Throughout the description of the preferred embodiment of the present invention, like components will be identified by like reference numerals.

Figure 2:
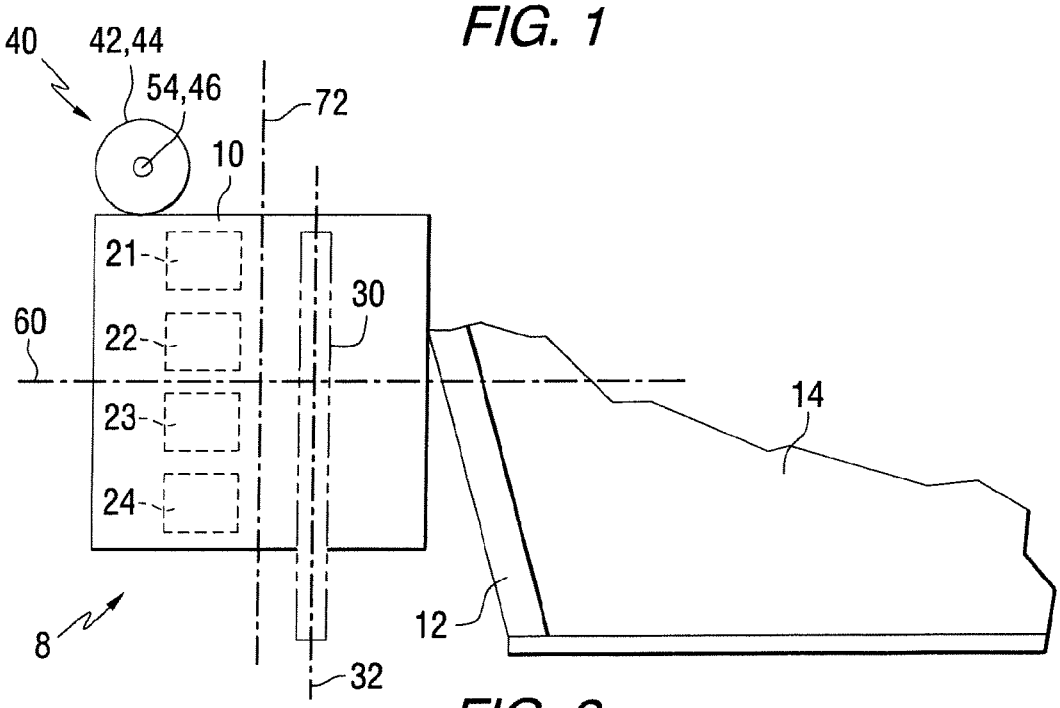

FIGS. 1 and 2 are highly simplified schematic representations of outboard motors. The purpose of FIGS. 1 and 2 is to describe certain terminology that will be used below in the description of the preferred embodiment of the present invention. These figures are not intended to be complete or show a fully illustrated outboard motor. Throughout the Figures, arrows A and E designate the air flow and exhaust flows, respectively.

In FIG. 1, an engine 10 of an outboard motor 8 is shown attached to a transom 12 of a marine vessel 14. FIG. 1 is a top view of the outboard motor 8 and marine vessel 14 and FIG. 2 is a side view.

In FIG. 2, the engine 10 is shown with four cylinders, 21-24, represented by dashed lines. In addition, a portion of a crankshaft 30 is shown. The crankshaft 30 is supported for rotation about a generally vertical axis 32. Although not shown in FIG. 2, those skilled in the art of marine propulsion systems are aware of the manner in which pistons are disposed in the cylinders, 21-24, for reciprocating motion. Those skilled in the art are also aware of the manner in which the pistons are connected to the crankshaft 30, which is symbolically represented in FIG. 2, so that the reciprocal movement of the pistons within the cylinders causes the crankshaft 30 to rotate about the vertical axis 32. The connection between the pistons and crankshaft 30, which comprises connecting rods, is therefore not illustrated in FIGS. 1 and 2.

With continued reference to FIGS. 1 and 2, the manner in which the outboard motor 10 is physically supported by the transom 12 is also not illustrated. Furthermore, those skilled in the art of marine propulsion systems are well aware that outboard motors suspend a driveshaft housing and gear case below the engine and provide appropriate gearing and shafts to drive the propeller in response to rotation of the crankshaft 30.

With continued reference to FIGS. 1 and 2, a turbocharger 40 is located above the engine 10. The turbocharger 40, as is well known to those skilled in the art, comprises a turbine portion 42 and a compressor portion 44 connected together by a shaft 46. The turbine portion 42 is supported for rotation about a turbine axis 50 and the compressor portion 44 is supported for rotation about a compressor axis 52. In a preferred embodiment of the present invention, the turbine axis 50 and the compressor axis 52 are coaxial and disposed collinearly with a turbocharger axis 54.

With continued reference to FIGS. 1 and 2, the plurality of cylinders, 21-24, are distributed vertically in a configuration which is generally perpendicular to a generally horizontal plane 60. The generally horizontal plane 60 extends through a vertical center of said plurality of cylinders. It should be understood that the various planes illustrated in FIGS. 1 and 2 are intended to facilitate the description of the various locations of components in a preferred embodiment of the present invention. The turbocharger axis 54 is generally parallel with the generally horizontal plane 60. In a preferred embodiment of the present invention, the turbocharger 40 is disposed above every one of the plurality of cylinders, 21-24. In alternative embodiments of the present invention, the turbocharger 40 can be disposed above a majority of the plurality of cylinders.

In FIG. 1, a first generally vertical plane 70 is shown in order to facilitate the description below relating to the position of the turbocharger 40 relative to the cylinders, 21-24. In a preferred embodiment of the present invention, the first generally vertical plane 70 extends through the crankshaft of the engine, but that is not necessary in all embodiments of the present invention. The plurality of cylinders is generally distributed on both sides of the first generally vertical plane. In other words, in an in-line engine having four cylinders, 21-24, the generally vertical plane 70 would intersect all of those cylinders with approximately equal portions of the cylinders being on both the port and starboard sides of the generally vertical plane 70. In a V-type engine, the two banks of cylinders would be on opposite sides of the generally vertical plane 70. It should be understood that the purpose of the generally vertical plane 70 is to facilitate the description of the relative position of the turbocharger 40 relative to the body of the engine 10. Although not limiting in all embodiments of the present invention, it is important to understand that the turbine portion 42 and the compressor portion 44 can lie on opposite sides of a vertical plane 70 with the cylinders of the engine 10 being disposed on both sides of that vertical plane. A second generally vertical plane 72 is also shown in FIGS. 1 and 2. The turbocharger 40 is disposed behind the second generally vertical plane 72 in a preferred embodiment of the present invention. In addition, the turbocharger is disposed behind the crankshaft 30. A second generally vertical plane is intended for illustrative purposes and extends through a vertical center of said plurality of cylinders and is generally perpendicular to the generally horizontal plane 60.

Throughout the description of the preferred embodiment of the present invention below, various terms will be used to show relative positions of components. This description generally follows the convention that the forward portion of the engine 10 is that portion in front of the second generally vertical plane 72 and closest to the transom 12. Therefore, when the turbocharger 40 is described as being behind either the second generally vertical plane 72 or the crankshaft 30, this means that the turbocharger is farther away from the transom 12 than those references. When the turbocharger 40 is described as being above another component, that means that it is at a higher position relative to that component when the outboard motor is attached to the transom 12 of the marine vessel 14 for its normal intended use. This term does not necessarily mean that one component is directly above another component merely by the fact that it was described as being at a higher position. As an example, in FIG. 2 the turbocharger 40 is shown above the engine 10 and above the generally horizontal plane 60. In FIGS. 1 and 2, the turbocharger 40 is shown behind the crankshaft 30 and behind the second generally vertical plane 72. The first generally vertical plane 70 essentially divides the engine 10 into port and starboard halves and the turbine portion 42 of the turbocharger 40 is on the starboard side of the first generally vertical plane 70 while the compressor portion 44 of the turbocharger 40 is on the port side. Although it is not required in all embodiments of the present invention that the turbine portion 42 and the compressor portion 44 are on opposite sides of the first generally vertical plane 70, they are so disposed in a particularly preferred embodiment of the present invention. In addition, the cylinders are described as being vertically distributed. This means that the cylinders are not necessarily all on a common horizontal plane but, instead, some cylinders are at a position that is above or higher than other cylinders. The relative position of the various components of the engine and the turbocharger 40 is important because the most significant advantages of the present invention are achieved through the relative positions. Potential water inversion damage to the turbocharger 40 is averted by those relative positions. Also, the air intake into the compressor portion 44 is facilitated by the relative position of the turbocharger to the engine. Similarly, the advantageous positioning of the turbocharger above the engine 10 and behind the crankshaft 30 helps to achieve these advantages and also facilitates the efficient packaging of the component within the limited space under the cowl of an outboard motor.

Figure 3:
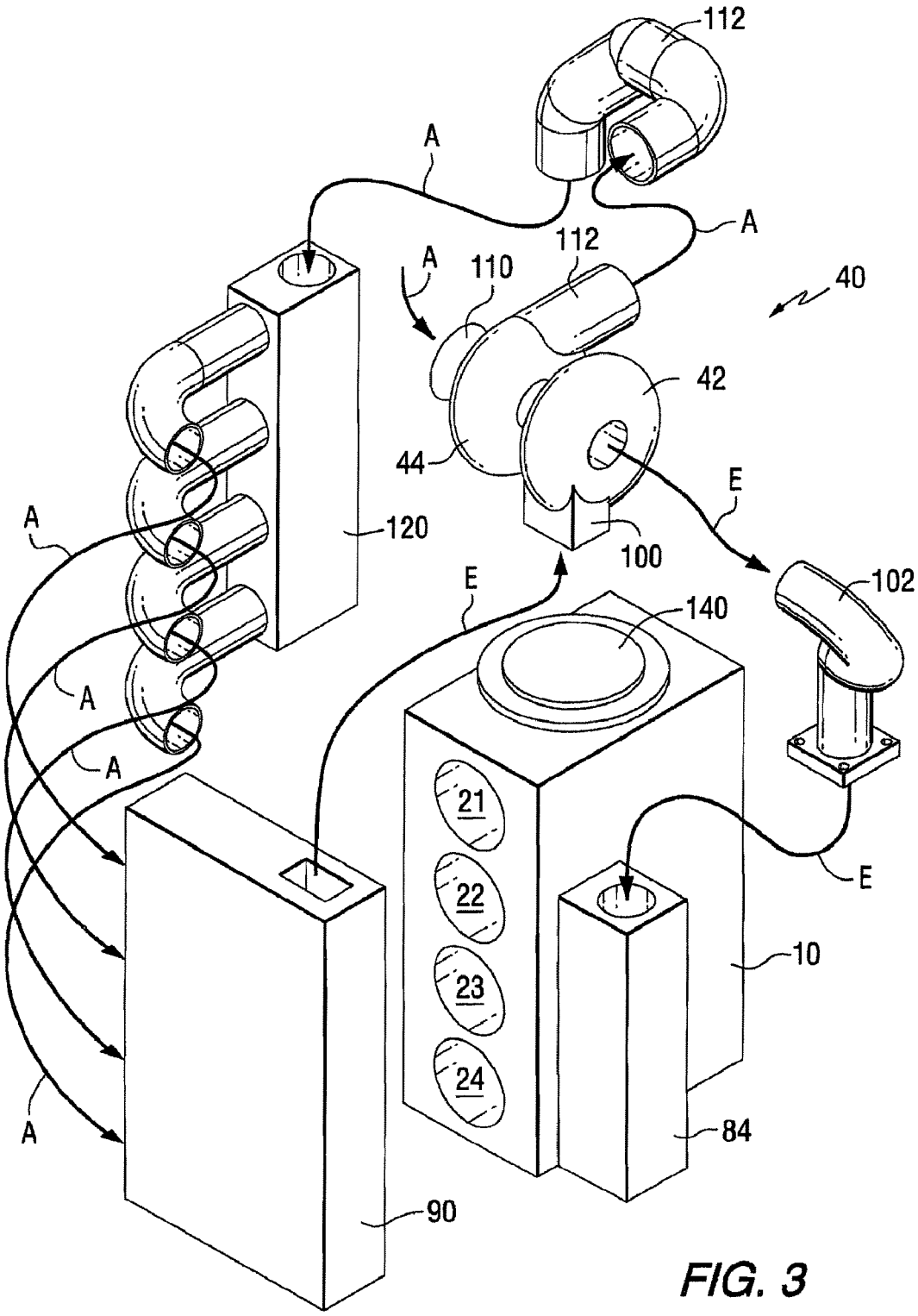
FIG. 3 is an exploded isometric view showing the major components of the present invention.
Figure 4:
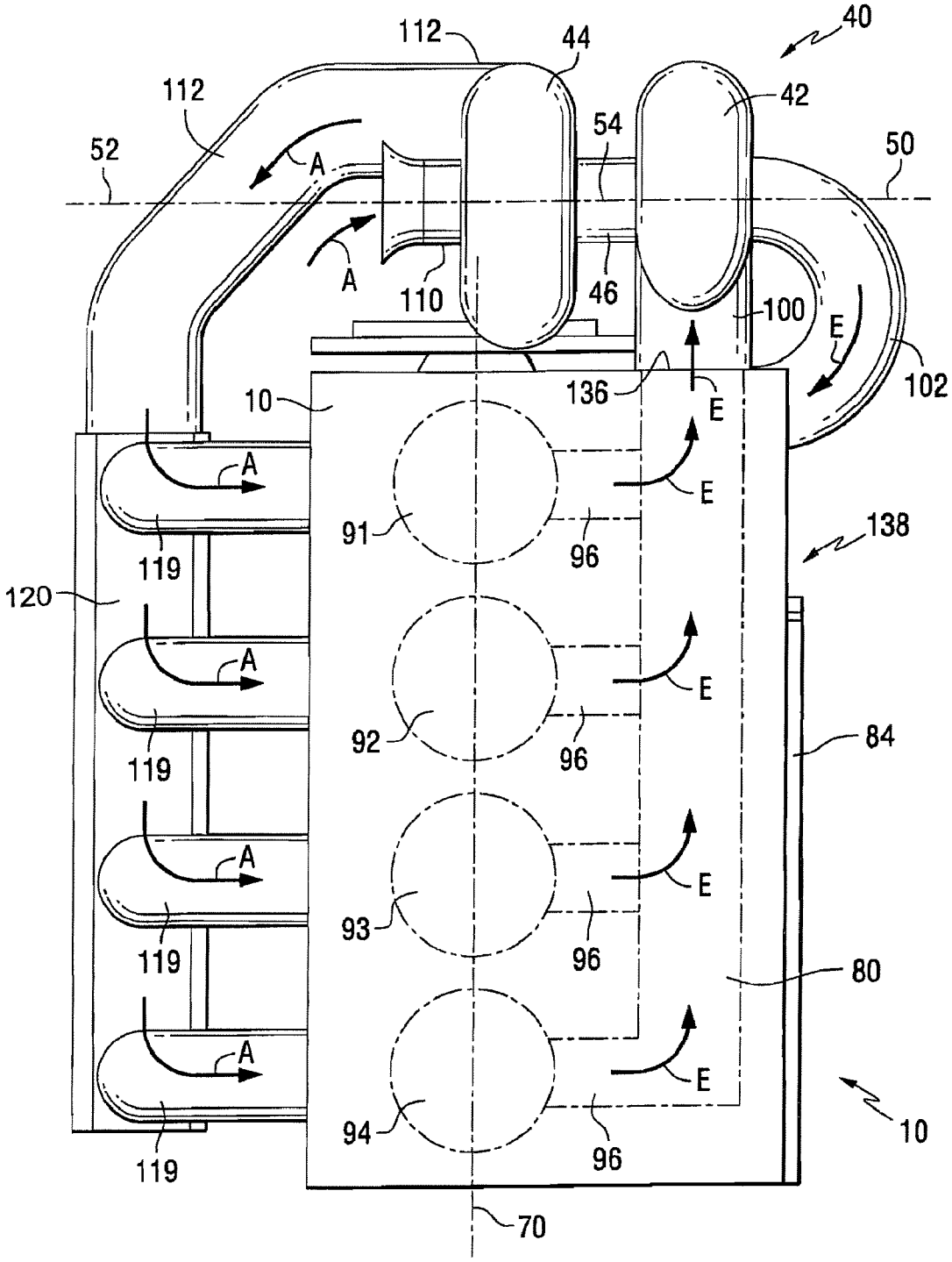
FIG. 4 is a section view showing the passages of exhaust gas and air through the various conduits and passages of an engine made in accordance with a preferred embodiment of the present invention.
Figure 5:
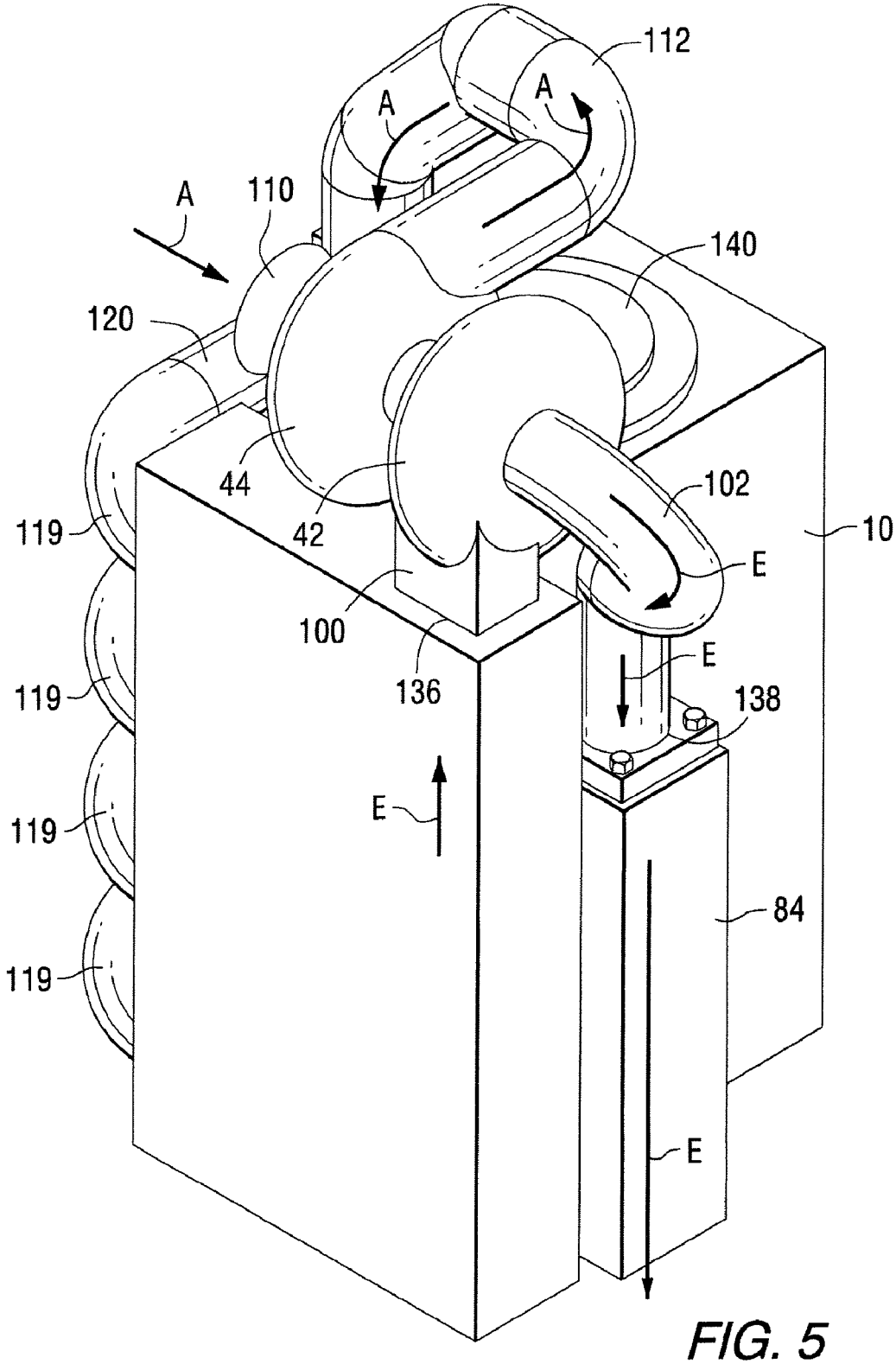
FIG. 5 is an isometric view which is an assembled version of the illustration shown in FIG. 4.

FIG. 3 is an exploded isometric view of an engine 10 and a turbocharger 40 arranged according to a particularly preferred embodiment of the present invention. FIG. 4 is a section view of an engine 10 showing the internal flow of exhaust gas from the cylinders, 21-24, through an exhaust manifold 80, into the turbine portion 42 of the turbocharger 40 and into an exhaust conduit 84 that is configured to direct the flow of exhaust gas through a lower portion of an outboard motor and, in many applications, through a propeller hub. The compressed air from the compressor portion 44 is directed through the compressor outlet 112 to an air intake manifold 120 that distributes the pressurized air to the combustion chambers, 91-94, through the intake passages 119. FIG. 5 is an isometric view of an engine 10 and a turbocharger 40 configured according to a preferred embodiment of the present invention. FIG. 5 is an assembled view of the exploded components shown in FIG. 3.

With continued reference to FIGS. 3-5, arrows E illustrate the path of exhaust gas as it passes from the combustion chambers associated with the cylinders, 21-24, through the exhaust manifold 80, through the turbine portion 42 of the turbocharger 40, and into the exhaust conduit 84 described above. The head 90 of the engine 10 defines a plurality of combustion chambers which are each associated with one of the cylinders, 21-24. The combustion chambers in FIG. 4 are identified by reference numerals 91-94. Exhaust gas passes from the combustion chambers, through relatively short exhaust passages 96 into the exhaust manifold 80 which directs the exhaust gas upwardly toward the turbocharger 40. The turbine portion 42 of the turbocharger comprises a turbine inlet 100 and a turbine outlet 102. As the exhaust gas passes through the turbine portion 42, it provides torque that drives the turbine of the turbocharger. From the turbine outlet 102, the exhaust gas is directed downwardly through the exhaust conduit 84 as shown in FIG. 5. The turbine portion is supported for rotation about a turbine axis 50 which, in the embodiments shown in FIGS. 3-5, is coaxial and collinear with the compressor axis 52. Together, these coaxial and collinear axes of rotation define the turbocharger axis 54. In FIG. 4, a first generally vertical plane 70, which is described above, is illustrated passing through the centers of the combustion chambers, 91-94. This first generally vertical plane 70 also passes through the crankshaft (not shown in FIGS. 3-5) and, as a result, the cylinders are equally distributed on both sides of the first generally vertical plane 70.

With continued reference to FIGS. 3-5, the compressor portion 44 of the turbocharger 40 is provided with a compressor inlet 110 and a compressor outlet 112. Rotation of the compressor rotor, about the compressor axis 52, draws air, represented by arrows A into the compressor inlet 110, compresses the air, and directs it through the compressor outlet 112. From there, the air is caused to flow through an air intake manifold 120 toward the combustion chambers, 91-94.

With specific reference to FIG. 4, it can be seen that the turbine inlet 100 and turbine outlet 102 are both located on the right side of the first generally vertical plane 70 in the view shown in FIG. 4 which, in turn, is a section view taken as viewed from the rear of the engine 10. Therefore, both the turbine inlet 100 and turbine outlet 102 are on the starboard side of the first generally vertical plane 70. The compressor outlet 112, on the other hand, is connected in fluid communication with the engine 10 at a location on a second side of the first generally vertical plane 70. This location is the connection between the compressor outlet 112 and the air intake manifold 120. Therefore, as illustrated, the outlet 112 of the compressor portion is connected to the engine on an opposite side of the first generally vertical plane 70 than the location, 136 and 138, where the turbine inlet 100 and turbine outlet 102 are connected to the engine. Although the generally horizontal plane 60 is not specifically illustrated in FIGS. 3-5, it should be understood that the vertical center of said plurality of cylinders through which it extends is below the uppermost cylinder 21 and therefore, since the turbocharger 40 is disposed above all of the cylinders in FIGS. 3-5, it must be disposed above the generally horizontal plane 60 which extends through the vertical center of said plurality of cylinders as defined herein.

Figure 6:
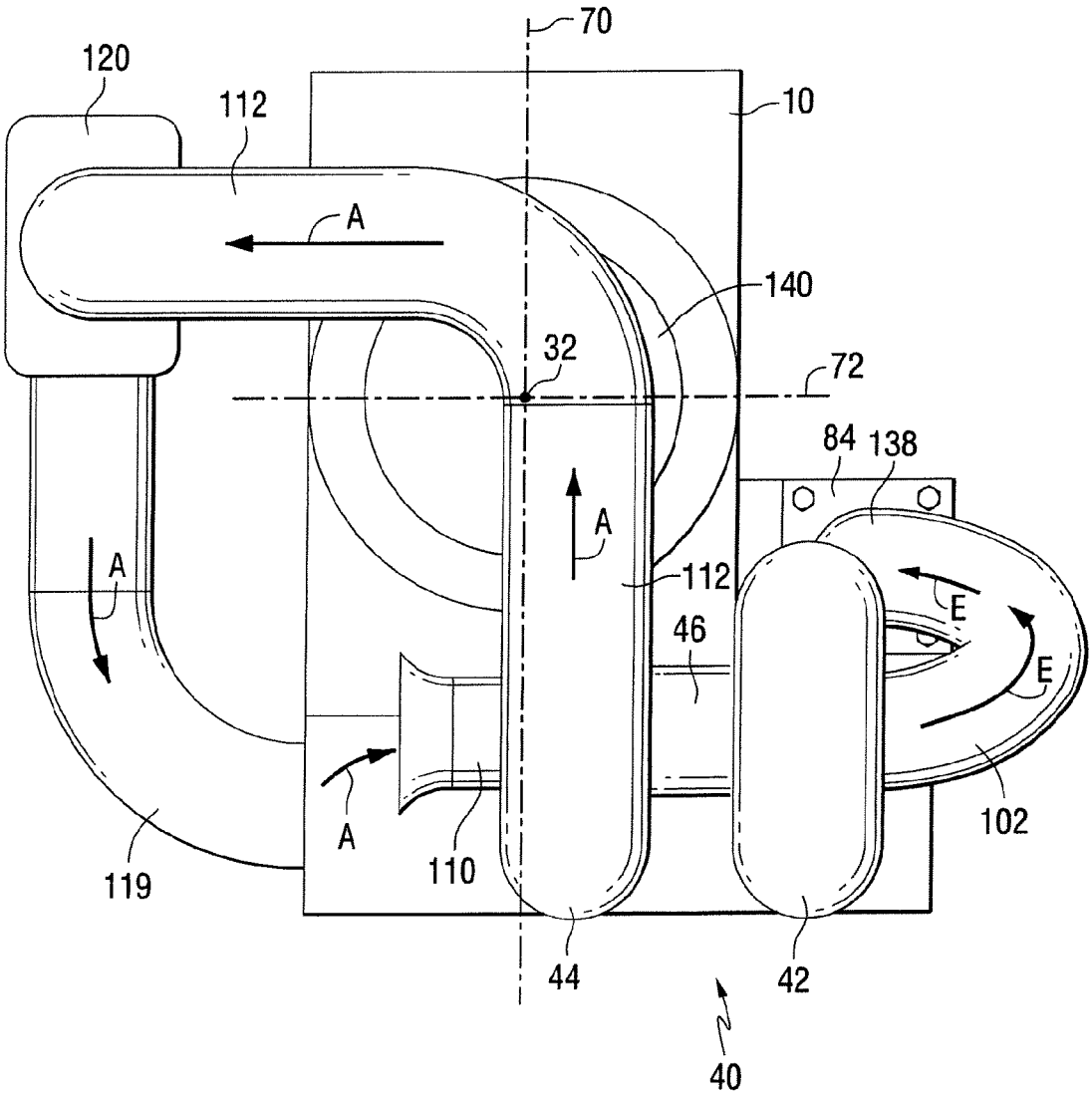
FIG. 6 is a top view of an engine with a turbocharger made in accordance with a preferred embodiment of the present invention.

FIG. 6 is a top view of an outboard motor engine 10 configured in accordance with a preferred embodiment of the present invention. The front or forward portion of the engine 10 is shown at the top of FIG. 6 and the rear portion, behind the crankshaft, is at the bottom of FIG. 6. The turbocharger 40 is therefore located behind the crankshaft and behind the second generally vertical plane 72. An exemplary flywheel 140 is shown at the top portion of the crankshaft 30 (not shown in FIG. 6). Air A flowing from the compressor outlet 112 is directed to the air intake manifold 120 where it is connected to the engine 10 at a location on the left side of the first vertical plane 70. This places it on an opposite side of the engine than the location where the turbine outlet 102 is attached to the engine to direct the exhaust gas through the exhaust conduit 84.

With continued reference to FIGS. 1-6, the location of the turbocharger 40 above all of the cylinders, 21-24, of the engine 10 requires that water must rise the entire vertical length of the engine, during a potential inversion process, in order to reach the turbocharger. This requires a highly unlikely set of circumstances and therefore minimizes the likelihood of any damage being caused to the turbocharger 40 or in the engine 10 in the event that relative pressures within the engine system draw water upwardly through the exhaust conduit 84 from the body of water in which the outboard motor is operated.

Figure 7:
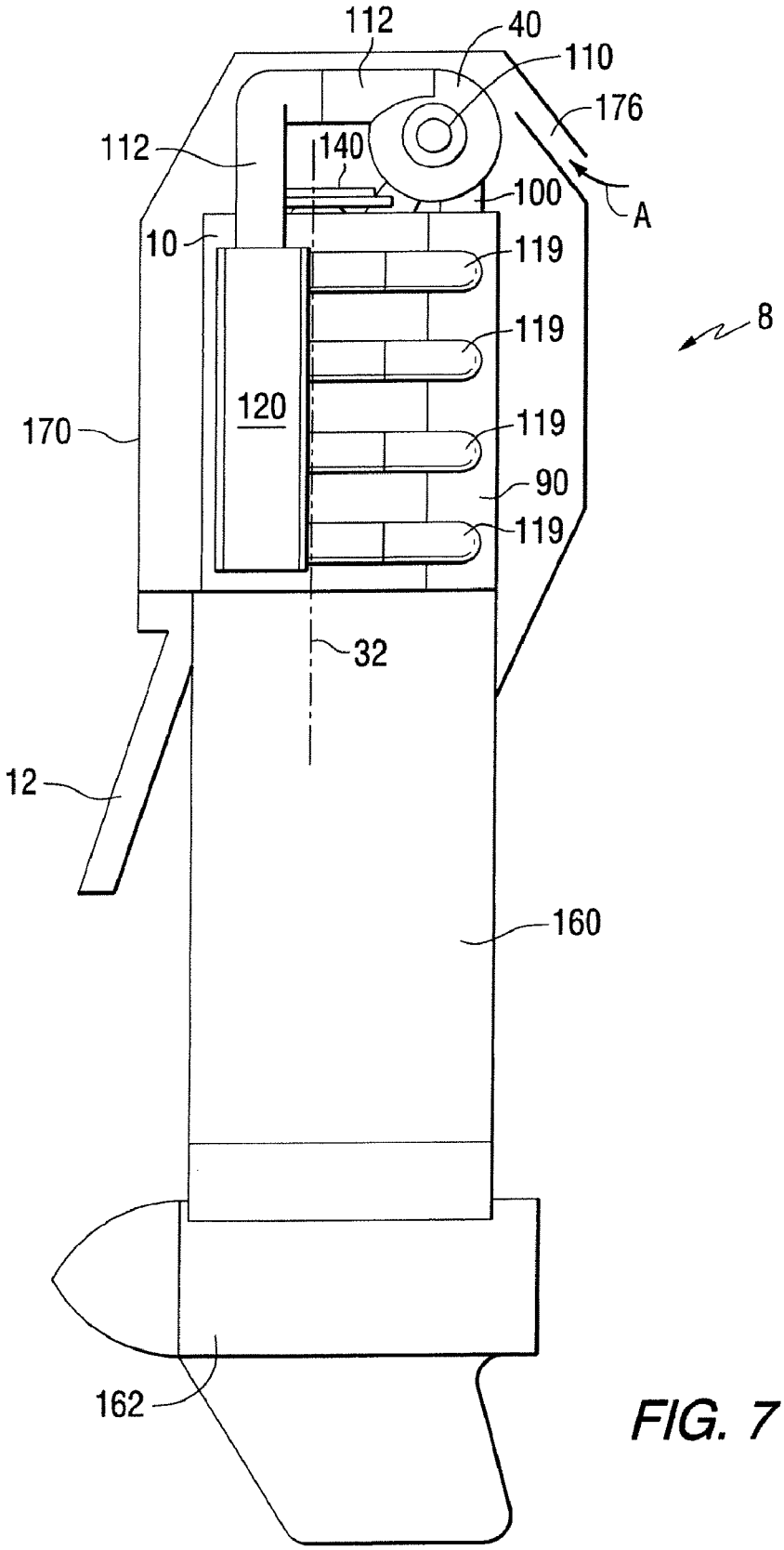
FIG. 7 is a side view, taken from the port side of an outboard motor, showing a marine propulsion device made in accordance with a preferred embodiment of the present invention.
Figure 8:
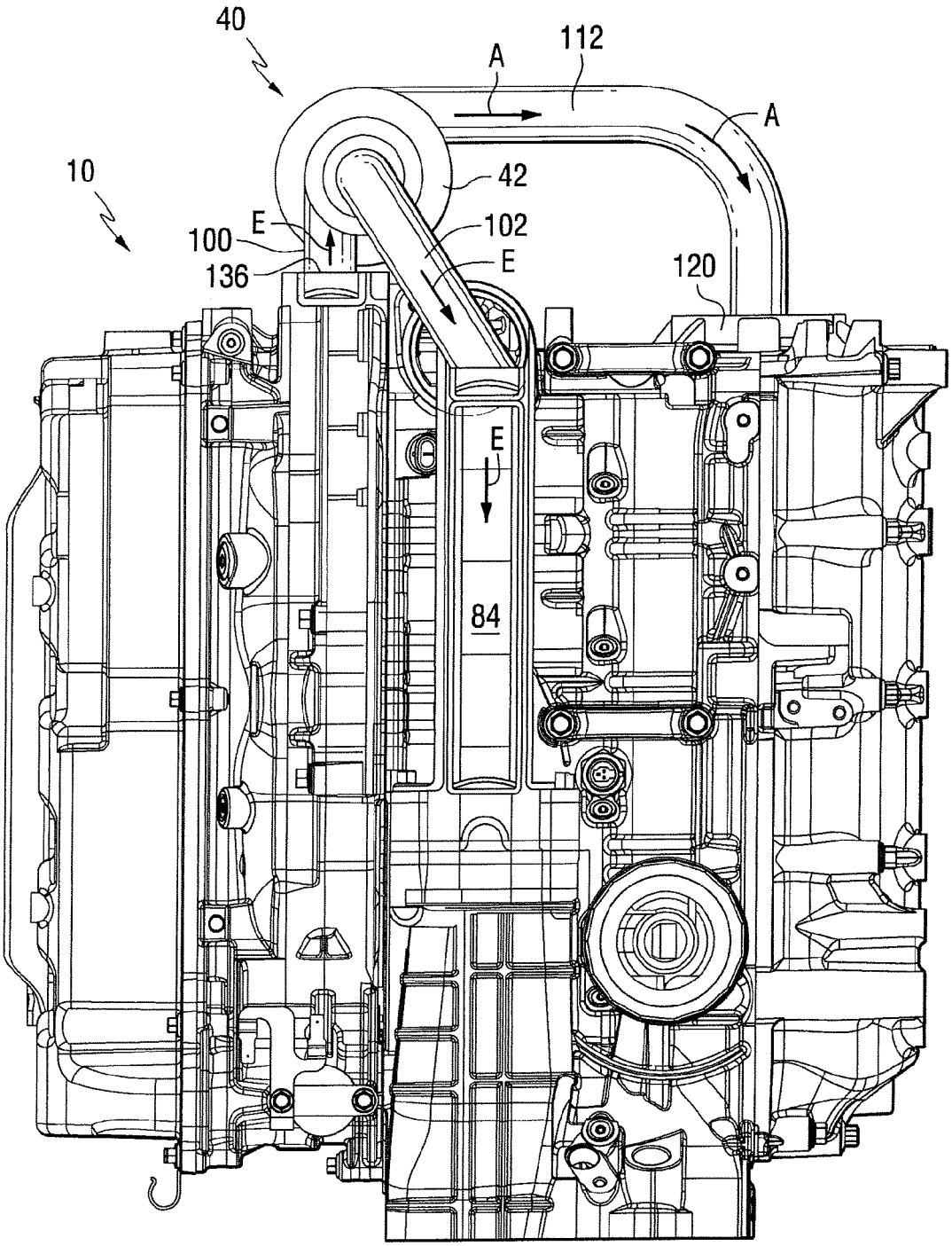
FIG. 8 shows a side view of an engine with a turbocharger in accordance with a preferred embodiment of the present invention.

FIG. 7 is a side view of an outboard motor 8 taken from the port side of the outboard motor. It is attached to the transom 12 as described above in conjunction with FIGS. 1 and 2. FIG. 8 is a side view of the outboard motor 8 taken from the opposite, or starboard, side of the outboard motor. As is well known to those skilled in the art, the outboard motor provides a driveshaft housing 160 below the engine 10 and a gear case 162 below the driveshaft housing. A cowl 170 is disposed over the engine 10 and its associated components. It is typical to provide an air intake duct 176 to allow air to flow into the space under the cowl 170 and around the engine 10. Placement of the turbocharger 40 above the engine 10 and behind the crankshaft beneficially places the compressor inlet 110 near the vent 176. This facilitates the ability of the turbocharger 40 to draw air into the inlet 110 to be compressed and subsequently directed through the compressor outlet 112 to the air intake manifold 120. This advantage is in addition to the characteristic of the present invention that inhibits the water from rising into the turbocharger 40 during water inversion incidents.

FIG. 8 shows an engine 10 made in accordance with a preferred embodiment of the present invention. The specific elements of the engine 10 will not be described with particular specificity in conjunction with FIG. 8 since the particular structure of the engine is not limiting to the overall scope of the present invention. Instead, the concepts of the present invention can be used in conjunction with many different types of engine 10. The purpose of FIG. 8 is to show the relative position of the turbocharger 40 above the engine. Exhaust E is directed upwardly from the exhaust manifold into the turbine portion 42 of the turbocharger 40. That exhaust causes the turbine rotor to rotate. The exhaust E is then directed downwardly toward the exhaust conduit 84 which directs the exhaust downwardly through the exhaust passages in the driveshaft housing and toward the propeller where the exhaust gas is emitted from the marine propulsion device. Compressed air is directed, through the compressor outlet 112, toward the air intake manifold 120 as described above. The placement of the turbocharger 40, as shown in FIG. 8, illustrates the advantages described above which are provided to by a preferred embodiment of the present invention. The location above the cylinders of the engine require that, in the event of an inversion situation, the water must rise above the highest cylinder in order to be capable of doing any damage to the engine. In addition, the water must be induced to rise above the engine in order to cause any potential harm to the turbocharger component.

With continued reference to FIGS. 1-8, it can be seen that a marine propulsion system made in accordance with a preferred embodiment of the present invention comprises an engine 10 which, in turn, comprises a plurality of cylinders, 21-24, and a plurality of pistons operatively attached to a crankshaft 30. Each of the plurality of pistons is disposed within an associated one of the plurality of cylinders and the crankshaft 30 is supported for rotation about a generally vertical axis 32. A turbocharger 40 comprises a turbine portion 42 and a compressor portion 44. The turbocharger 40 is disposed above a generally horizontal plane 60 that extends through a vertical center of said plurality of cylinders. The turbine portion 42 comprises a turbine rotor supported for rotation about a turbine axis 50. The compressor portion 44 comprises a compressor rotor supported for rotation about a compressor axis 52. The plurality of cylinders, 21-24, is distributed vertically in a configuration which is generally perpendicular to the generally horizontal plane 60. The turbine axis 50 and the compressor axis 52, in a particularly preferred embodiment of the present invention, are coaxial with each other and disposed collinearly with a turbocharger axis 54. The turbocharger axis 54 is generally parallel with the generally horizontal plane 60 and, in a preferred embodiment of the present invention, is disposed above every one of the plurality of cylinders, 21-24. In other embodiments of the present invention, the turbocharger 40 can be disposed above a majority of the plurality of cylinders.

The present invention can further comprise a turbine inlet 100 configured to conduct exhaust gas E from the engine 10 into the turbocharger 40, a turbine outlet 102 configured to conduct exhaust gas E from the turbocharger 40 to an exhaust passage 84 of the marine propulsion system, a compressor inlet 110 configured to direct air into the turbocharger 40, and a compressor outlet 112 configured to direct air A from the turbocharger 40 to the plurality of cylinders, typically through an air intake manifold 120. The turbine inlet 100 and turbine outlet 102 are connected in fluid communication with the engine 10 at locations on a first side of a first generally vertical plane 70 extending through the crankshaft of the engine 10 with the plurality of cylinders, 21-24, with the plurality of cylinders being generally equally distributed on both sides of the first generally vertical plane 70. The compressor outlet 112 is connected in fluid communication with the engine 10 at a location on a second side of the first generally vertical plane 70. The turbocharger 40 is disposed behind the crankshaft 30 and is generally perpendicular to the generally horizontal plane 60 in a preferred embodiment of the present invention.

Although the present invention has been described in particular detail and illustrated to show a particular embodiment, it should be understood that alternative embodiments are also within its scope.

We claim:

1. A marine propulsion system comprising an engine comprising a plurality of cylinders and a plurality of pistons operatively attached to a crankshaft, each of said plurality of pistons being disposed within an associated one of said plurality of cylinders, said crankshaft being supported for rotation about a generally vertically axis, a turbocharger comprising a turbine portion and a compressor portion, said turbocharger being disposed above a generally horizontal plane that extends through a vertical center of said plurality of cylinders, said turbine portion comprising a turbine rotor supported for rotation about a turbine axis, said compressor portion comprising a compressor rotor supported for rotation about a compressor axis, said plurality of cylinders being distributed vertically in a configuration which is generally perpendicular to said generally horizontal plane, said turbine axis and said compressor axis being coaxial and disposed colinearly with a turbocharger axis, said turbocharger axis being generally parallel with said generally horizontal plane, a turbine inlet configured to conduct exhaust gas from said engine into said turbocharger, a turbine outlet configured to conduct exhaust gas from said turbocharger to an exhaust passage of said marine propulsion system, a compressor inlet configured to direct air into said turbocharger, a compressor outlet configured to direct air from said turbocharger to said plurality of cylinders, said plurality of cylinders being vertically aligned along a vertical alignment plane, said turbine portion and said compressor portion being connected together by a turbocharger shaft extending axially therebetween, said turbine portion, said turbocharger shaft and at least a section of said compressor portion being on one axial side of said vertical alignment plane, wherein said compressor inlet is on another axial side of said vertical alignment plane distally opposite said one side, wherein said turbine inlet, said turbine outlet and said compressor outlet are all on said one axial side of said vertical alignment plane, wherein said compressor portion straddles said vertical alignment plane such that one section of said compressor portion is on said one axial side of said vertical alignment plane, and another section of said compressor portion is on said other axial side of said vertical alignment plane, wherein said vertical alignment plane extends vertically through the centerline diameters of said plurality of cylinders.

2. The marine propulsion system according to claim 1 wherein exhaust from said plurality of cylinders flows into a common vertically extending exhaust manifold, and wherein said turbine portion is vertically aligned with said common vertically extending exhaust manifold.

* * * * *